US011415387B2

(12) United States Patent
Lindstrom

(10) Patent No.: US 11,415,387 B2
(45) Date of Patent: Aug. 16, 2022

(54) PICATINNY RAIL WITH INTEGRATED FIRE STARTER

(71) Applicant: Thomas Eric Lindstrom, Powers Lake, ND (US)

(72) Inventor: Thomas Eric Lindstrom, Powers Lake, ND (US)

( * ) Notice: Subject to any disclaimer, the term of this patent is extended or adjusted under 35 U.S.C. 154(b) by 0 days.

(21) Appl. No.: 16/999,728

(22) Filed: Aug. 21, 2020

(65) Prior Publication Data

US 2022/0057168 A1 Feb. 24, 2022

(51) Int. Cl.
*F41C 27/00* (2006.01)
*F23Q 1/06* (2006.01)

(52) U.S. Cl.
CPC ..... *F41C 27/00* (2013.01); *F23Q 1/06* (2013.01)

(58) Field of Classification Search
CPC ..... F41C 27/00; F23Q 1/06
See application file for complete search history.

(56) References Cited

U.S. PATENT DOCUMENTS 856,016 A * 6/1907 Balson ..... F41C 23/22 42/71.01
894,101 A * 7/1908 Balson ..... F41C 23/22 42/71.01
1,028,008 A * 5/1912 Eslick, Jr. ..... B25F 1/04 7/168
1,782,544 A * 11/1930 Myers ..... F23Q 2/18 431/273
2,098,139 A * 11/1937 Foley ..... F41C 23/22 42/106
2,496,840 A * 2/1950 Alexander ..... B26B 11/001 431/202
3,402,029 A * 9/1968 Sampson, Jr. ..... F23Q 1/02 431/6
3,744,169 A * 7/1973 Straight ..... F41C 9/08 42/69.01
4,188,192 A * 2/1980 Levenson ..... C10L 11/00 44/510
4,203,243 A * 5/1980 Hickman ..... F41C 23/14 42/112
4,328,634 A * 5/1982 Wiltrout ..... F41A 35/02 42/96
4,348,829 A * 9/1982 Bosco ..... F41A 35/02 42/96
4,404,979 A * 9/1983 Hobbs ..... F41C 9/085 134/166 C
4,422,255 A * 12/1983 Lapp ..... F41C 9/08 42/51
4,471,550 A * 9/1984 Kyper ..... F41C 9/08 42/51
4,682,434 A * 7/1987 Wurm ..... F41C 9/08 42/51
4,698,068 A * 10/1987 Jensen ..... C10L 11/00 431/269

(Continued)

*Primary Examiner* — Michelle Clement

(57) ABSTRACT

A combination picatinny rail and fire starter system according to various aspects of the present technology is configured to provide a standard mounting system for a firearm that can be used to start a fire in the event of an emergency. Various embodiments of the combination picatinny rail and fire starter system comprise a rail that can be used to provide a flammable material to help start a fire and a striker that can be used to create a spark used to ignite the flammable material.

8 Claims, 3 Drawing Sheets

(56) References Cited

U.S. PATENT DOCUMENTS 4,702,029 A * 10/1987 DeVaul ..... F41C 33/06 42/94
4,770,669 A * 9/1988 Allen ..... C10L 11/00 44/510
4,944,392 A * 7/1990 Hull ..... B25F 1/00 206/102
5,016,380 A * 5/1991 Jones ..... B25F 1/02 42/90
5,068,991 A * 12/1991 Reed ..... F41C 23/22 42/71.01
D323,838 S * 2/1992 Rebstock ..... D15/144
5,214,853 A * 6/1993 Bray ..... B26B 11/00 30/183
5,279,628 A * 1/1994 Hutchens ..... F24B 15/005 44/506
5,566,489 A * 10/1996 Artman ..... F41C 9/08 42/83
6,128,845 A * 10/2000 Jacobson ..... A62C 99/0054 42/1.15
6,497,064 B1 * 12/2002 Keaton ..... F41C 23/20 42/71.01
6,536,152 B1 * 3/2003 Wisz ..... F41C 23/22 42/1.02
6,640,480 B2 * 11/2003 Williams ..... F41A 29/00 42/95
6,782,576 B1 * 8/2004 Valencic ..... B24D 15/06 7/158
6,925,744 B2 * 8/2005 Kincel ..... F41C 23/22 42/71.01
6,981,344 B2 * 1/2006 Cahill ..... F41C 23/10 42/71.01
7,134,234 B1 * 11/2006 Makarounis ..... F41G 11/004 42/146
7,249,390 B2 * 7/2007 Yale ..... B25F 1/02 7/128
7,802,392 B2 * 9/2010 Peterson ..... F41A 11/02 42/75.03
7,877,919 B2 * 2/2011 Richards ..... F41A 9/46 42/51
7,946,070 B1 * 5/2011 Elhart ..... F41A 23/16 42/94
8,028,459 B2 * 10/2011 Williams ..... F41G 11/003 42/90
8,087,193 B2 * 1/2012 Kincel ..... F41C 23/20 42/74
8,186,995 B2 * 5/2012 Putrello, Jr. ..... F23Q 1/06 431/273
8,196,328 B2 * 6/2012 Simpkins ..... F41C 23/22 42/73
8,578,644 B1 * 11/2013 Oquin ..... F41G 11/003 42/90
8,661,723 B2 * 3/2014 Emde ..... F41C 27/00 42/71.02
8,806,795 B1 * 8/2014 Kay ..... F41G 11/003 42/90
8,844,185 B2 * 9/2014 Jarboe ..... F41C 23/14 42/73
8,845,123 B2 * 9/2014 Fridley ..... F41G 11/001 362/110
8,904,691 B1 * 12/2014 Kincel ..... F41C 23/16 42/71.01
8,943,728 B2 * 2/2015 Ward ..... F41C 23/22 42/71.01
9,464,806 B2 * 10/2016 Hensley ..... F23Q 1/06
9,568,282 B1 * 2/2017 Schorman ..... G03B 17/561
9,732,959 B2 * 8/2017 Holland ..... F23Q 1/06
9,845,955 B1 * 12/2017 Villarreal ..... F23Q 1/06
9,986,789 B2 * 6/2018 Blackman ..... A44B 11/005
10,104,942 B2 * 10/2018 Miller ..... A44B 11/22
10,247,520 B2 * 4/2019 Manly ..... F16B 21/186
10,393,377 B2 * 8/2019 Holland ..... F23Q 1/06
10,684,011 B2 * 6/2020 Seitler, Jr. ..... A45C 13/008
11,021,668 B2 * 6/2021 Willis ..... C10L 11/08
11,035,647 B2 * 6/2021 Brown ..... F41C 27/16
2005/0211284 A1 * 9/2005 Dooley ..... A45B 3/00 135/65
2007/0256347 A1 * 11/2007 Fitzpatrick ..... F41A 11/02 42/96
2007/0278262 A1 * 12/2007 Gallagher ..... F41C 33/002 224/150
2008/0263927 A1 * 10/2008 Orlob ..... F41C 9/085 42/90
2009/0282721 A1 * 11/2009 Confrey ..... F41C 23/22 42/90
2009/0288324 A1 * 11/2009 Peterson ..... F41A 11/02 42/75.03
2010/0050690 A1 * 3/2010 Woodward ..... A44C 5/0007 63/15.1
2010/0263255 A1 * 10/2010 Harris ..... F41C 27/00 42/90
2011/0072705 A1 * 3/2011 Simpkins ..... F41C 9/02 42/59
2012/0009004 A1 * 1/2012 Chu ..... B43K 7/005 401/195
2012/0204354 A1 * 8/2012 Knapp ..... B26B 3/00 7/158
2012/0279105 A1 * 11/2012 Emde ..... F41C 23/22 42/1.08
2013/0189631 A1 * 7/2013 Mojica ..... F23Q 1/06 431/274
2015/0059221 A1 * 3/2015 Bero ..... F41A 3/66 42/16
2015/0276335 A1 * 10/2015 Daley, Jr. ..... F41A 3/66 42/75.01
2015/0308686 A1 * 10/2015 Hensley ..... F41A 29/02 42/90
2016/0201905 A1 * 7/2016 Villareal ..... F23Q 1/06 431/273
2017/0299180 A1 * 10/2017 Holland ..... F23Q 2/22
2017/0360159 A1 * 12/2017 Anderson ..... F23Q 1/06
2019/0011127 A1 * 1/2019 Seitler, Jr. ..... F23Q 2/22
2020/0348105 A1 * 11/2020 Gill ..... F41C 33/002
2021/0247162 A1 * 8/2021 Conway ..... F41C 23/20

* cited by examiner

PICATINNY RAIL WITH INTEGRATED FIRE STARTER

BACKGROUND OF THE TECHNOLOGY

Picatinny rails are a common rail interface system used on firearms to provide a mounting location for additional accessories such as a scope, iron sights, reflex sights, tactical lights, grips, and stands. Picatinny rails are commonly built to a mil-spec standard thereby allowing a standard mounting system for any type of firearm or accessory.

SUMMARY OF THE TECHNOLOGY

A combination picatinny rail and fire starter system according to various aspects of the present technology is configured to provide a standard mounting system for a firearm that can be used to start a fire in the event of an emergency. Various embodiments of the combination picatinny rail and fire starter system comprise a rail that can be used to provide a flammable material to help start a fire and a striker that can be used to create a spark used to ignite the flammable material.

BRIEF DESCRIPTION OF THE DRAWINGS

A more complete understanding of the present technology may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present technology.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various materials, finishes, dimensions, and geometries, which may carry out a variety of operations suited to a specified application or environment. In addition, the present technology may be practiced in conjunction with any number of systems configured for operation with firearms, and the system described is merely one exemplary application for the invention. Further, the present technology may employ any number of conventional techniques for providing a mounting rail for a firearm, starting a fire, and the like.

A rail according to various aspects of the present technology may operate in conjunction with any type of semi-automatic or automatic firearm. Various representative implementations of the present technology may be applied to any type of firearm including a handgun or rifle and the disclosed system may be used with any suitable existing firearm.

Figure 1:
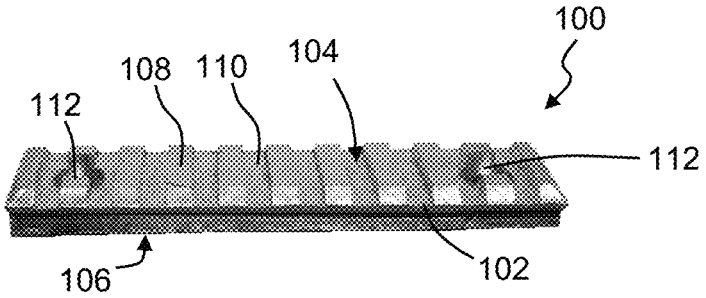
FIG. 1 representatively illustrates a side perspective view of a rail in accordance with an exemplary embodiment of the present technology.
Figure 2:
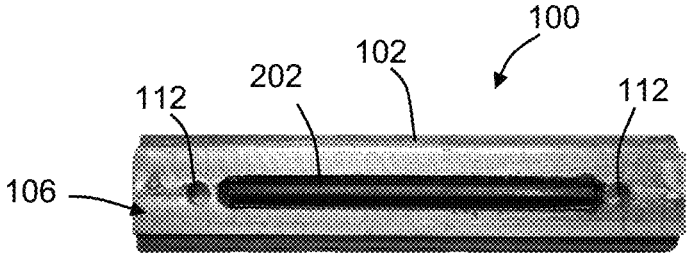
FIG. 2 representatively illustrates a bottom view of the rail in accordance with an exemplary embodiment of the present technology.
Figure 3:
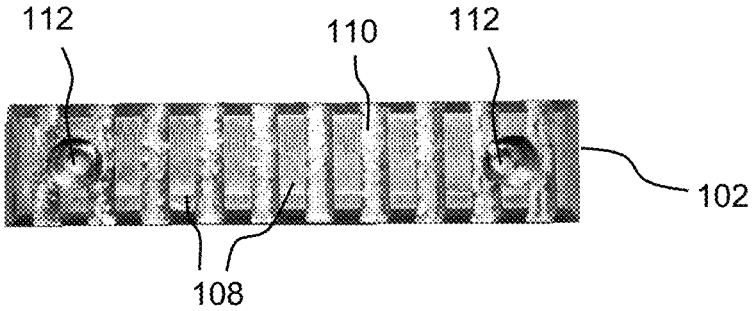
FIG. 3 representatively illustrates a top view of the rail in accordance with an exemplary embodiment of the present technology.
Figure 4:
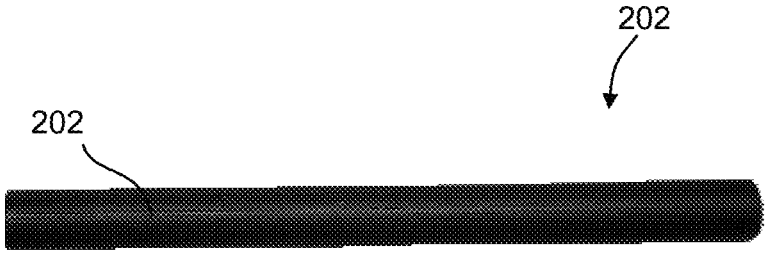
FIG. 4 representatively illustrates a striker in accordance with an exemplary embodiment of the present technology.
Figure 5:
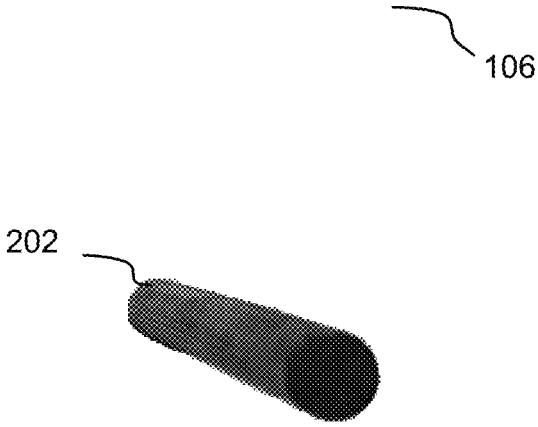
FIG. 5 representatively illustrates an end view of the striker in accordance with an exemplary embodiment of the present technology.
Figure 6:
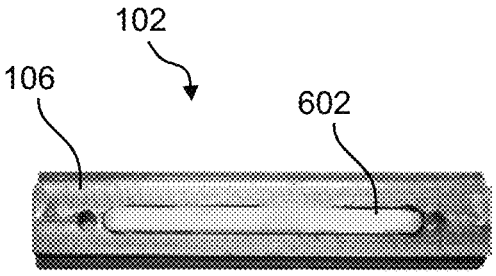
FIG. 6 representatively illustrates a bottom view of the rail with the striker removed in accordance with an exemplary embodiment of the present technology.

Referring to FIGS. 1-3, in one embodiment a mounting rail 100 may generally comprise a body 102, a top surface 104, and a lower surface 106. The top surface 104 of the mounting rail 100 may comprise a plurality of raised flat portions 108 having a groove (slot) 110 positioned between each individual raised flat portion 108. At least two thru holes 112 may be used to attach the mounting rail 100 to the firearm. The lower surface 106 may comprise a striker 202.

The body 102 may be attached to a top portion or side of the firearm. For example, the thru holes 112 may be positioned within the body 102 such that they align with a set of mating mounting holes on the firearm. A fastener such as a screw or bolt may be extended through the thru holes 112 and screwed into the mating mounting holes.

The body may comprise any suitable dimensions that may be determined, at least in part, by the type of firearm the mounting rail 100 is being attached to or the type of accessory that will be mounted to the mounting rail 100 itself. For example, the body 102 may comprise a length of between about two inches and about twenty inches. The number of raised flat portions 108 and grooves 110 disposed along the length of the body 102 may comprise any suitable number of between two and thirty.

The body 102 is sufficiently rigid enough to provide a secure attachment for any suitable firearm accessory. The body 102 may be comprised of any material capable of providing the required rigidity while also providing a material that can be shaved to provide small flammable particles that can be used to start a fire. For example, in one embodiment, the body 102 may be formed from a block of flammable metal such as magnesium, calcium, lithium, neodymium, and the like. In an alternative embodiment, the body 102 may be formed of a composite material that likewise provides required rigidity while also providing a material that can be shaved to provide small flammable particles that can be used to start a fire The striker 202 is used to generate a spark to ignite the flammable particles from the body 102. The striker may comprise any suitable device or system for generating a spark. For example, in one embodiment, the striker 202 may comprise a ferrocerium rod configured to generate a high temperature spark when another object is rubbed, or otherwise struck, against the striker 202. In an alternative embodiment, the striker 202 may comprise a metal or other material capable of generating a spark.

Referring now to FIGS. 2 and 4-6, the striker 202 may be embedded within a recess 602 positioned in the lower surface 106 of the body 102. The striker 202 may comprise any suitable size or dimension that allows the striker 202 to be positioned within the recess 602. For example, the striker

202 may comprise a circular rod having a radius that is equal to or slightly less than a depth of the recess 602. This allows the striker 602 to be positioned completely within the recess 602 allowing the lower surface 106 of the body to be positioned flush against the firearm when attached to the firearm. The striker 602 may comprise a length less than that of the recess 602 to allow for easier removal of the striker 602 when needed. In an alternative embodiment, the striker 602 may extend outward from the lower surface 106 slightly. This may allow the striker to be used without having to be removed from the body 102 or to allow for easier removal.

Figure 7:
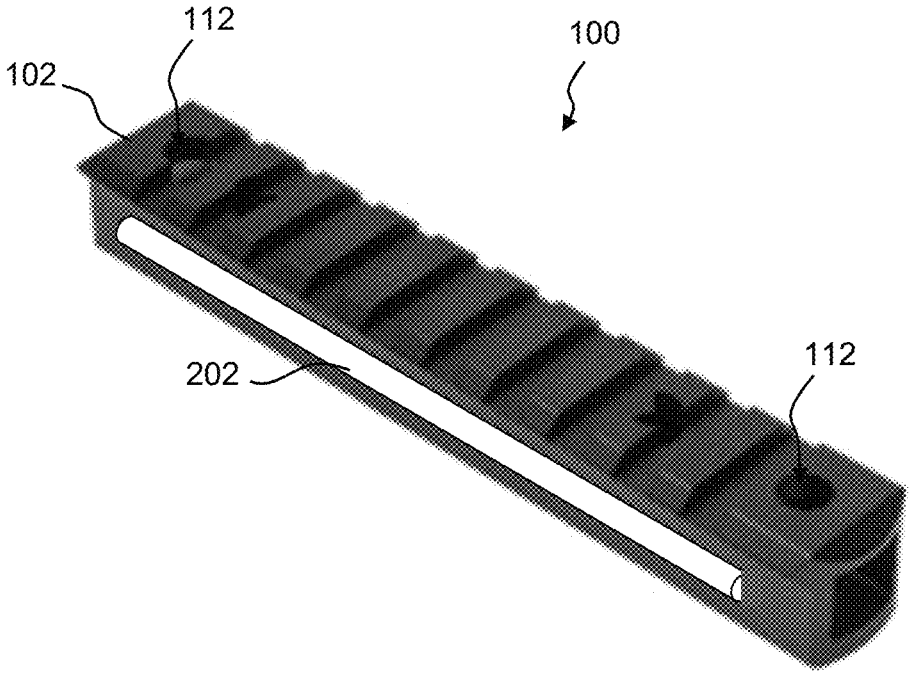
FIG. 7 representatively illustrates an alternative embodiment of the rail in accordance with an exemplary embodiment of the present technology.

Referring now to FIG. 7, in another embodiment, the recess 602 may be positioned along a side portion of the body rather than the lower surface 106. This configuration allows the striker 202 to be positioned along a side of the body 102 to allow access to the striker 202 without having to remove the body 102 from the firearm prior to use.

In use, the mounting rail 100 may be attached to a firearm and used as a typical picatinny rail. In the event that a user needs to start a fire, the body 102 may be removed from the firearm and a separate device such as a knife may be scraped across a surface of the body 102 to create shavings. These shavings may be piled up or integrated into other materials that will be used to start and/or maintain a fire. Once a sufficient amount of shavings has been created, the user may remove the striker 202 from the body 102 and use to create sparks to ignite the shavings as typically done with a standard magnesium-based fire starter device. After the fire has been started, the striker 202 may be repositioned within the body 102 and the mounting rail 100 reattached to the firearm.

These and other embodiments for forming an integrated mounting rail and fire starter may incorporate concepts, embodiments, and configurations as described above. The particular implementations shown and described are illustrative of the technology and its best mode and are not intended to otherwise limit the scope of the present technology in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The technology has been described with reference to specific exemplary embodiments. Various modifications and changes, however, may be made without departing from the scope of the present technology. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The invention claimed is:

1. An attachable mounting rail for a firearm, comprising:
- a body formed of a flammable material, the body comprising:
  - a series of grooves and flat portions disposed along a top surface of the body;
  - a lower surface disposed on an opposite side of the body as the top surface, wherein at least a portion of the lower surface fits flush against the firearm when the attachable mounting rail is attached to the firearm;
  - a pair of thru holes passing through the top surface and the lower surface of the body; and
  - a recess positioned within an exterior facing surface of the body; and
- a ferrocerium rod removably disposed within the recess.

2. An attachable mounting rail according to claim 1, wherein the recess is positioned in the lower surface.

3. An attachable mounting rail according to claim 2, wherein the ferrocerium rod is positioned completely within the recess.

4. An attachable mounting rail according to claim 1, wherein the flammable material comprises magnesium.

5. An attachable mounting rail according to claim 1, wherein the exterior facing surface comprises a side surface extending between the top surface and the lower surface of the body.

6. An attachable mounting rail according to claim 5, wherein the ferrocerium rod is positioned completely within the recess.

7. An attachable mounting rail according to claim 5, wherein the ferrocerium rod extends outwardly from the side surface when positioned within the recess.

8. An attachable mounting rail according to claim 2, wherein the recess is positioned between the pair of thru holes.

* * * * *